US007938688B2

(12) United States Patent
Teramoto

(10) Patent No.: US 7,938,688 B2
(45) Date of Patent: May 10, 2011

(54) ELECTRIC CABLE DEVICE AND INFORMATION REPRODUCTION SYSTEM

(75) Inventor: Kayo Teramoto, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 12/782,341

(22) Filed: May 18, 2010

(65) Prior Publication Data

US 2010/0297889 A1 Nov. 25, 2010

(30) Foreign Application Priority Data

May 25, 2009 (JP) ..... 2009-125690

(51) Int. Cl.
*H01R 24/00* (2011.01)
*H01R 33/00* (2006.01)

(52) U.S. Cl. ..... 439/660

(58) Field of Classification Search ..... 439/660
See application file for complete search history.

(56) References Cited

U.S. PATENT DOCUMENTS 6,338,651 B1 * 1/2002 Svette et al. ..... 439/559

FOREIGN PATENT DOCUMENTS

| | | | |
|---|---|---|---|
| JP | 2002-124345 | A | 4/2002 |
| JP | 2004-171976 | A | 6/2004 |
| JP | 2004-327325 | A | 11/2004 |
| JP | 2006-228449 | A | 8/2006 |

* cited by examiner

*Primary Examiner* — Javaid Nasri
(74) *Attorney, Agent, or Firm* — Global IP Counselors

(57) ABSTRACT

An electric cable device includes an electric cable, and a plug component. The plug component includes a terminal body with a plurality of plug terminals, a hood component, and a plug body. The hood component is disposed around the terminal body. The hood component has a width measured in a first direction of the plug component. The width of the hood component is greater than a height of the hood component that is measured in a second direction of the plug component. The first direction is perpendicular to the second direction. The plug body is disposed around part of the hood component such that the hood component protrudes from the plug body in a third direction of the plug component with the third direction being perpendicular to the first and second direction. The plug body is asymmetrically formed relative to any of planes that are perpendicular to the second direction.

17 Claims, 7 Drawing Sheets

ELECTRIC CABLE DEVICE AND INFORMATION REPRODUCTION SYSTEM

CROSS-REFERENCE TO RELATED APPLICATIONS

This application claims priority to Japanese Patent Application No. 2009-125690 filed on May 25, 2009. The entire disclosure of Japanese Patent Application No. 2009-125690 is hereby incorporated herein by reference.

BACKGROUND

1. Field of the Invention

The present invention generally relates to an electric cable device. More specifically, the present invention relates to an electric cable device that is connected to an electric device.

2. Background Information

HDMI (High-Definition Multimedia Interface) is a type of multimedia interface for transmitting uncompressed digital data including digital video signals and digital audio signals along with control signals through a single, integrated cable. Information reproduction devices that have HDMI terminals have been quite popular in recent years. The information reproduction devices, such as DVD players, are increasingly being connected to video display devices, such as television receivers, by an HDMI cable device. An HDMI terminal is generally provided to a rear face of the information reproduction device or video display device. When a user connects a plug of the HDMI cable device in a position in which the user looks down the HDMI terminal from a top or a side of the information reproduction device or video display device, but without being aware of which side is up or down (or left or right), if the plug does not fit to the HDMI terminal, then the user has to turn it upside down or switch it left to right and then insert it again.

As discussed above, when the user connects the HDMI cable device without being aware of which side is up or down (or left or right), since a hood of the plug is made of metal, there is the risk of scratching the rear face, or damaging a plug terminal portion of the plug. Furthermore, this makes the connection work take longer and imposes a burden on the user.

Another conventional connector includes an incorrect insertion prevention member (see Japanese Laid-Open Patent Application No. 2006-228449, for example). The incorrect insertion prevention member has guide pieces and support pieces. The guide pieces are expanded to the left and right by two distal end corner parts of a suitable plug inserted suitably into the conventional connector. The support pieces are provided to the distal end parts of the guide pieces and support the left and right side faces of a different type of plugs.

Another conventional connector includes a hooded connector and a coupling connector (see Japanese Laid-Open Patent Application No. 2004-327325, for example). The hooded connector fits together with the coupling connector. An inner surface shape of a hood of the hooded connector is made to correspond to an outer surface shape of the coupling connector.

Another conventional connector includes a plug and a terminal (see Japanese Laid-Open Patent Application No. 2004-171976, for example). An outer surface shape of the plug that is inserted into the terminal is vertically or laterally asymmetrical.

Furthermore, another conventional connector includes receiving-side and insertion-side connectors (see Japanese Laid-Open Patent Application No. 2002-124345, for example). The receiving-side and insertion-side connectors prevent reverse insertion. With the connectors, a plurality of protrusions exert a force that pushes guide keys upward in guide grooves, so the receiving-side connector and the insertion-side connector are fixed in the guide grooves and fitted together. The insertion-side connector is divided into two pieces with an upper housing and a lower housing that has a lock lever.

However, with the conventional connectors, when an electric device, such as an information reproduction device or a video display device, is connected to an electric cable device with the conventional connectors, it is still difficult to tell the correct connection direction between the electric cable device and the electric device.

SUMMARY

The present invention was conceived in light of the above-mentioned problem. One object of the present invention is to provide an electric cable device with which it becomes easier to correctly connect the electric cable device.

In accordance with one aspect of the present invention, an electric cable device includes an electric cable, and a plug component. The plug component is coupled to at least one end portion of the electric cable. The plug component includes a terminal body with a plurality of plug terminals, a hood component, and a plug body. The plug terminals are electrically coupled to the electric cable. The hood component is disposed around the terminal body. The hood component has a width measured in a first direction of the plug component. The width of the hood component is greater than a height of the hood component that is measured in a second direction of the plug component. The first direction is perpendicular to the second direction. The plug body is disposed around part of the hood component such that the hood component protrudes from the plug body in a third direction of the plug component with the third direction being perpendicular to the first and second direction. The plug body is asymmetrically formed relative to any of planes that are perpendicular to the second direction.

With this electric cable device, it becomes easier to correctly connect the electric cable device.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the selected embodiments are provided for illustration only and not for the purpose of limiting the invention as defined by the appended claims and their equivalents.

First Embodiment

Figure 1:
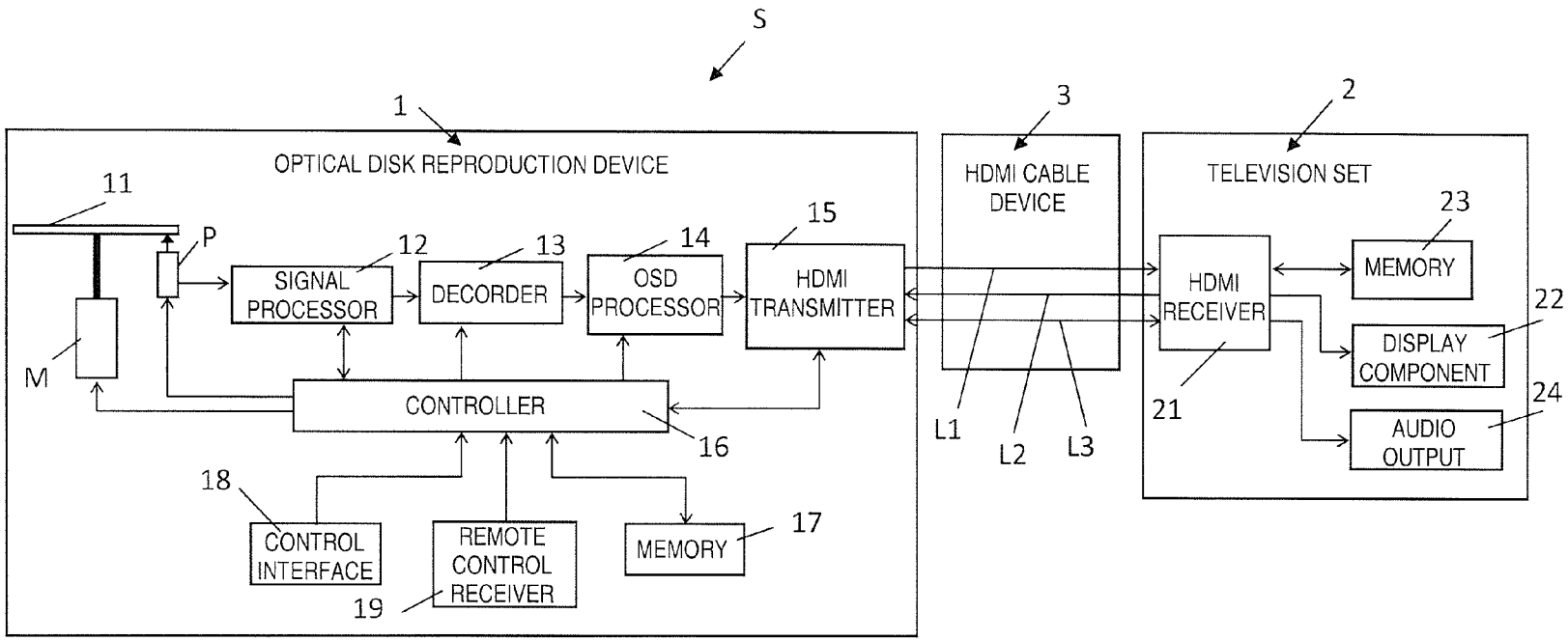
FIG. 1 is a block diagram illustrating an information reproduction system in accordance with a first embodiment.

An information reproduction system S will now be described through reference to FIGS. 1 to 8. As shown in FIG. 1, the information reproduction system S includes an optical disk reproduction device (e.g., information reproduction device) 1, a liquid crystal television set (e.g., video display device) 2, and an HDMI (High-Definition Multimedia Interface) cable device (e.g., electric cable device) 3. The HDMI cable device 3 electrically connects the liquid crystal television set 2 and the optical disk reproduction device 1 for transmitting uncompressed digital data. The HDMI cable device 3 has one of four HDMI connector types, such as Type A, Type B, Type C, and Type D.

Figure 2:
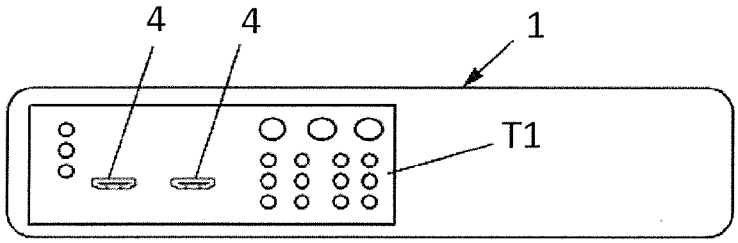
FIG. 2 is a rear elevational view of an optical disk reproduction device of the information reproduction system illustrated in FIG. 1.

The optical disk reproduction device 1 includes a spindle motor M for rotating an optical disk 11, an optical pickup P, a signal processor 12, a decoder 13, an OSD (On Screen Display) processor 14, an HDMI transmitter 15, a controller 16, a memory 17, a control interface 18, and a remote control receiver 19. The optical pickup P emits a laser beam on the optical disk 11 to read signals written to the optical disk 11. The signal processor 12 processes the signals read by the optical pickup P. The decoder 13 decodes the signals processed by the signal processor 12. The OSD processor 14 superimposes text or graphic OSD data on the decoded signals outputted from the decoder 13, or outputs text or graphic OSD data directly. The HDMI transmitter 15, as shown in FIG. 2, has a plurality (two in FIG. 2) of HDMI connectors (e.g., first socket component) 4. The HDMI connectors 4 are provided to a terminal board T1 disposed on a rear face of the HDMI transmitter 15 (or the optical disk reproduction device 1). The HDMI transmitter 15 receives EDID (Extended Display Identification Data) from the television set 2, and transmits HDMI format video and audio data based on an output signal of the OSD processor 14 via the HDMI connectors 4 to the television set 2. The controller 16 controls the spindle motor M, the optical pickup P, the signal processor 12, the decoder 13, the OSD processor 14, the HDMI transmitter 15, and the memory 17. The control interface 18 has various control buttons. The control interface 18 outputs code signals corresponding to the control buttons that are pressed by the user to the controller 16, thereby sending the user's commands to the controller 16. The remote control receiver 19 receives infrared signals from a remote control transmitter (not shown), outputs code signals corresponding to operation of the remote control transmitter by the user, and sends the user's commands to the controller 16. The optical disk 11 can be placed in and removed from the optical disk reproduction device 1.

Figure 3:
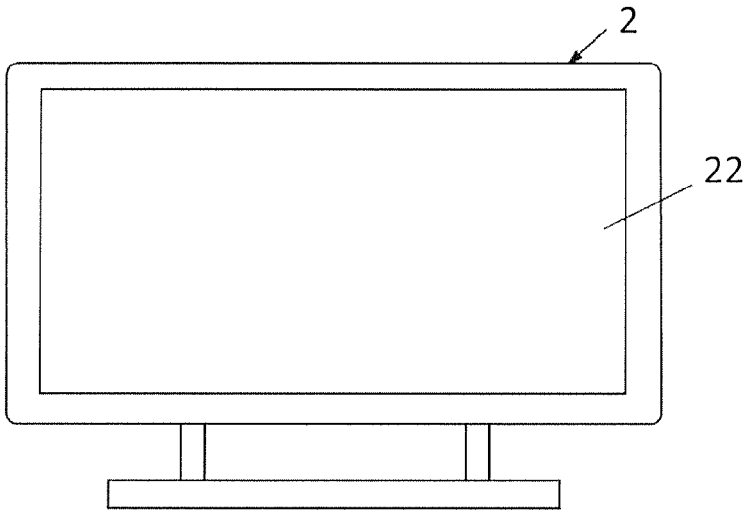
FIG. 3 is a front elevational view of a television set of the information reproduction system illustrated in FIG. 1.
Figure 4:
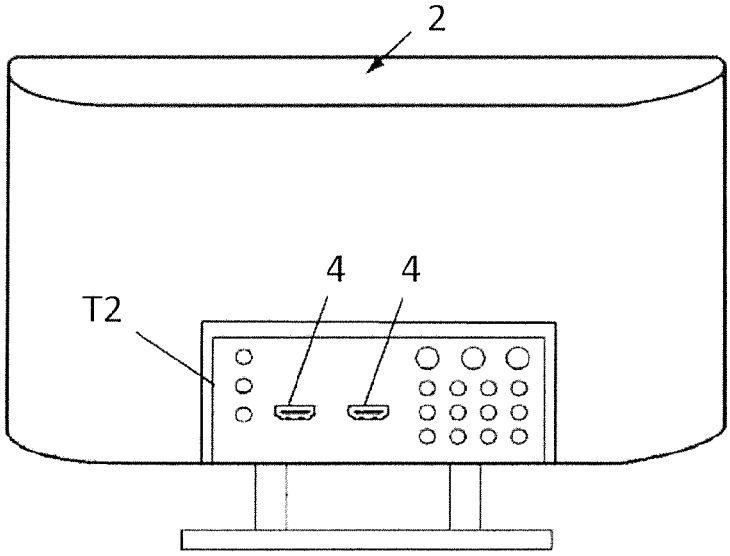
FIG. 4 is a rear elevational view of the television set illustrated in FIG. 3.

As shown in FIGS. 1, 3 and 4, the television set 2 includes an HDMI receiver 21, a display component 22, a memory 23, and an audio output 24. Although not depicted, the television set 2 also includes a television broadcast receiving component for receiving analog and/or digital television broadcasts. The HDMI receiver 21 has a plurality (two in FIG. 4) of HDMI connectors (e.g., second socket component) 4. The HDMI connectors 4 are provided to a terminal board T2 disposed on a rear face of the HDMI receiver 21 (or the television set 2). The HDMI receiver 21 transmits the EDID to the optical disk reproduction device 1, and receives the HDMI format video and audio data from the optical disk reproduction device 1. The display component 22 displays video based on the video data received by the HDMI receiver 21. The audio output 24 outputs audio based on the audio data received by the HDMI receiver 21.

Figure 5:
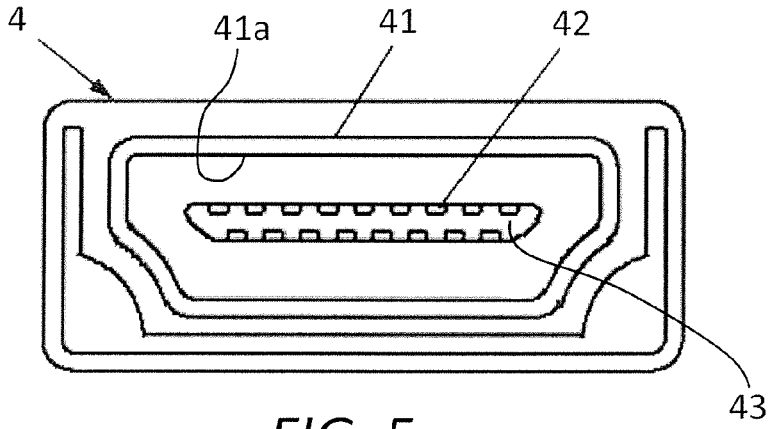
FIG. 5 is a detailed view of an HDMI connector of the optical disk reproduction device illustrated in FIG. 2 and the television set illustrated in FIG. 4.

As shown in FIG. 5, the HDMI connectors 4 provided to the optical disk reproduction device 1 and the television set 2 are so-called female HDMI connectors (e.g., receptacle connectors or sockets), and are coupled and connected to the HDMI cable device 3 so that a hood 51 of the HDMI cable device 3 is fitted in the HDMI connectors 4. The HDMI connector 4 includes a shell 41, a plurality (19, 29, etc.) of connector terminals 42, and a terminal body 43. The shell 41 has a shape similar to that of a trapezoid. The connector terminals 42 are provided on the inside of the shell 41 so that the connector terminals 42 are surrounded by an inside peripheral face 41*a* of the shell 41. The connector terminals 42 are provided on the terminal body 43 along an outer peripheral face of the terminal body 43. The terminal body 43 is disposed within the shell 41. The terminal body 43 is made of synthetic resin.

Figure 6:
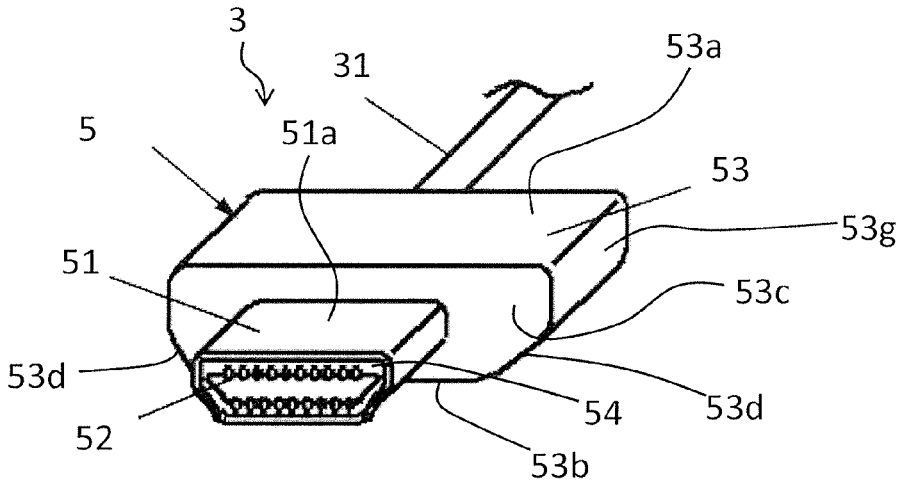
FIG. 6 is a perspective view of an HDMI cable device of the information reproduction system illustrated in FIG. 1.

As shown in FIGS. 1 and 6, the HDMI cable device 3 has an HDMI cable (e.g., electric cable) 31 and a pair of HDMI plugs (e.g., plug components or first and second plug components) 5 provided to both ends (e.g., end portions) of the HDMI cable 31. The HDMI cable 31 has a TMDS (Transition Minimized Differential Signaling) line L1, an HPD (hot plug detector) line L2, and a DDC (display data channel) line L3. The TMDS line L1 transmits audio/video data from the HDMI transmitter 15 to the television set 2 by TMDS. The HPD line L2 detects whether or not the optical disk reproduction device 1 is connected to the television set 2 by the HDMI cable device 3. The DDC line L3 performs bidirectional communication of status or controls between the optical disk reproduction device 1 and the television set 2. The optical disk reproduction device 1 acquires the EDID from the television set 2 through the DDC line L3 of the HDMI cable device 3. The EDID sent form the television set 2 to the optical disk reproduction device 1 includes resolution information for the display component 22.

With this constitution, the user operates the remote control transmitter or the various control buttons on the control interface 18 of the optical disk reproduction device 1 to view an image displayed on the display component 22 of the television set 2, and to hear audio from the audio output 24 at the same time. The user can also operate a remote control or control interface (not shown) provided to the television set 2 to tune to a desired channel in order to view the desired television broadcast on the display component 22 and hear the audio from the audio output 24 at the same time.

Figure 7A:
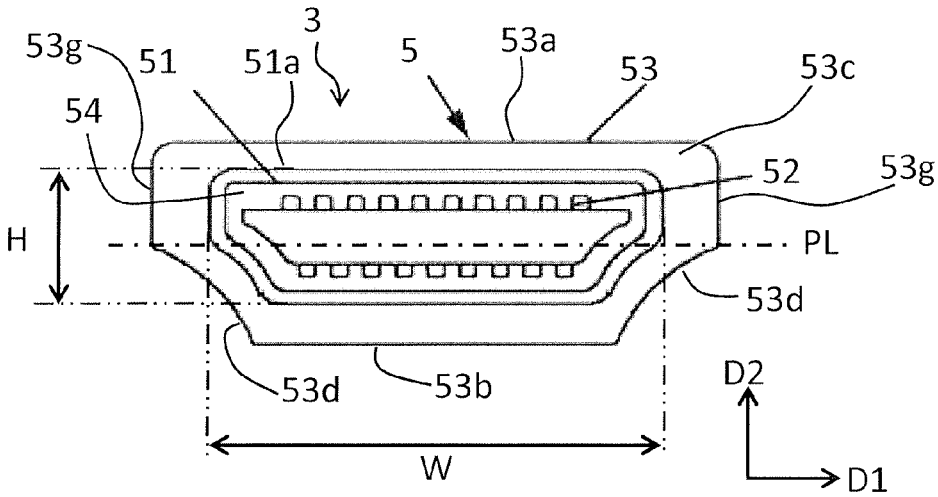
FIG. 7A is a front elevational view of the HDMI cable device illustrated in FIG. 6.
Figure 7B:
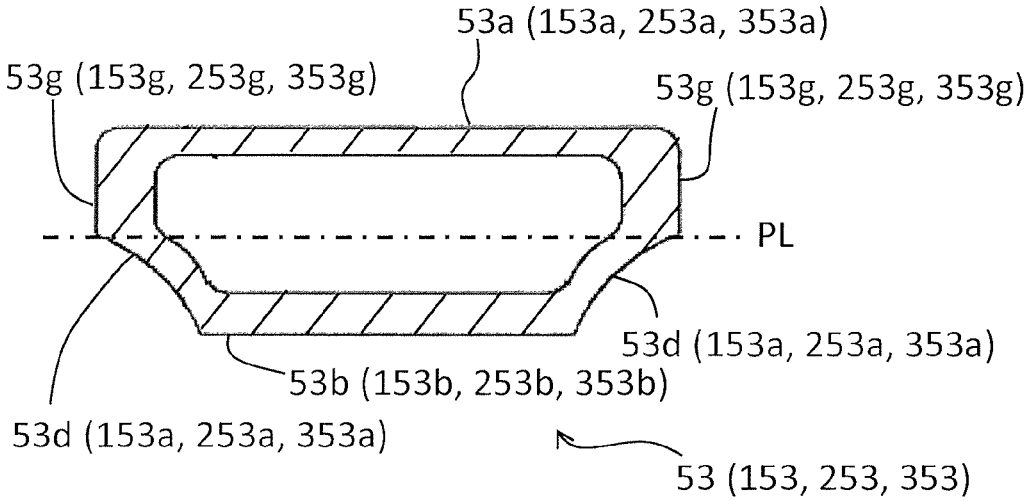
FIG. 7B is a cross sectional view of a plug body of the HDMI cable device taken along the VIIB-VIIB line in FIGS. 8, 10, 12 and 14.
Figure 8:
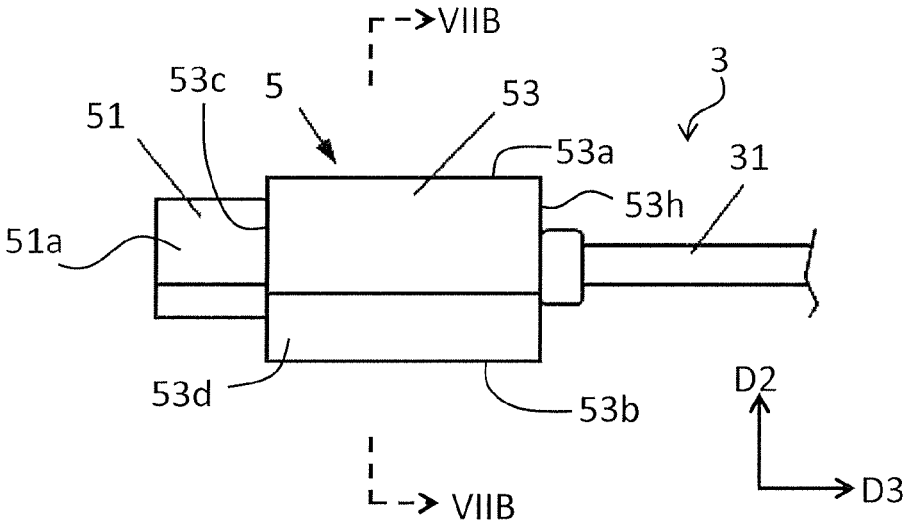
FIG. 8 is a side elevational view of the HDMI cable device illustrated in FIG. 7.

As shown in FIGS. 6 to 8, the HDMI cable device 3 has a pair of male HDMI plugs 5 at both ends of the HDMI cable 31. The HDMI plugs 5 are coupled and connected to the HDMI connectors 4 of the optical disk reproduction device 1 and the television set 2. The HDMI plugs 5 have a shape corresponding to that of the HDMI connectors 4. Each of the HDMI plugs 5 includes a hood (e.g., hood component) 51, a plurality (19, 29, etc.) of plug terminals 52, a plug body 53, and a terminal body 54. The hood 51 is formed in a shape that is analogous to the profile on the inside peripheral face 41*a* of the shell 41 of the HDMI connector 4. As shown in FIG. 7A, the hood 51 is disposed around the terminal body. The hood 51 has a width W measured in a horizontal direction (e.g., first direction) D1 of the HDMI plug 5. The width W of the hood 51 is greater than a height H of the hood 51 that is measured in a vertical direction (e.g., second direction) D2 of the HDMI plug 5. The horizontal direction D1 is perpendicular to the vertical direction D2. The hood 51 is made of metal. An outer peripheral face 51*a* of the hood 51 is fitted into the inside peripheral face 41*a* of the shell 41. The plug terminals 52 are provided in an interior of the hood 51 and are connected to connector terminals 42 of the HDMI connector 4, respectively. The plug terminals 52 are provided on the terminal body 54 along an inner peripheral face of the terminal body 54. The terminal body 54 is made of synthetic resin. The inner peripheral face of the terminal body 54 receives the outer peripheral face of the terminal body 43 of the HDMI connector 4 such that the plug terminals 52 are electrically coupled to the connector terminals 42, respectively. The plug body 53 covers part of the HDMI cable 31 and part of the hood 51. The plug body 53 is made of a plastic resin or other such insulating material. The cross sectional shape of the plug body 53 as viewed in the direction of insertion into the HDMI connector 4 has an outer profile that corresponds in shape to an outer profile of the outer peripheral face 51*a* of the hood 51 (e.g., outer profile of a cross sectional shape of the hood 51). More specifically, the cross sectional shape of the plug body 53 as viewed in the direction of insertion into the HDMI connector 4 has the outer profile that is analogous or similar to the outer profile of the outer peripheral face 51*a* of the hood 51. In particular, as shown in FIG. 7B, the cross sectional shape of the plug body 53 is formed in a shape similar to an inverse trapezoidal shape.

More specifically, as shown in FIGS. 7A and 7B, the plug body 53 has a vertically asymmetrical shape with respect to any of horizontal planes that are parallel to upper and lower faces 53*a* and 53*b* of the plug body 53. In particular, the plug body 53 has a vertically asymmetrical shape with respect to a horizontal plane PL that is parallel to upper and lower faces 53*a* and 53*b* of the plug body 53 and is located midway between the upper and lower faces 53*a* and 53*b* of the plug body 53 (i.e., a distance between the horizontal plane PL and the upper face 53*a* is equal to a distance between the horizontal plane PL and the lower face 53*b*). The plug body 53 further has a front face 53*c*, a pair of slope faces (e.g., first and second slope faces) 53*d* at lower corners of the plug body 53, and a pair of side faces (e.g., first and second side faces) 53*g*. Each of the slope faces 53*d* extends downwardly and inwardly from a vertical middle portion of a respective one of the side faces 53*g* of the plug body 53 to a respective one of edge portions of the lower face 53*b* of the plug body 53. The side faces 53*g* is perpendicular to the horizontal direction D1. The lower face 53*b* is perpendicular to the vertical direction D2. The slope faces 53*d* further axially extend from the front face 53*c* to a rear face 53*h* in an axial direction (e.g., third direction) D3 that is parallel to a center axis of the hood 51, respectively. In other words, the slope faces 53*d* axially extend entirely along the plug body 53. The axial direction D3 is perpendicular to both of the horizontal and vertical directions D1 and D2. The vertical middle portions of the side faces 53*g* of the plug body 53 are formed at a vertical position that is horizontally aligned to both of the hood 51 and the terminal body 54. Furthermore, the edge portions of the lower face 53*b* of the plug body 53 are formed at horizontal positions that are vertically aligned to both of the hood 51 and the terminal body 54, respectively. The hood 51 protrudes frontward relative to the front face 53*c*. The front face 53*c* also has a vertically asymmetrical shape with respect to the horizontal plane PL. When the HDMI plug 5 is connected to the HDMI connector 4, the hood 51 is inserted into the shell 41, and is disposed within the shell 41. Furthermore, the terminal body 43 is inserted into the terminal body 54, and is disposed within the terminal body 54. When the HDMI plug 5 is connected to the HDMI connector 4, the plug body 53 is not positioned within the shell 41. The plug body 53 is disposed outside of the shell 41 such that the front face 53*c* of the plug body 53 axially faces with a distal end portion of the shell 41. Furthermore, as shown in FIG. 8, the HDMI cable 31 extends rearward from the rear face 53*h* in a direction parallel to the axial direction D3.

When the user connects the optical disk reproduction device 1 and the television set 2 with the HDMI cable device 3, the user can easily recognize that there is only one correct insertion direction merely by grasping or touching to the plug body 53 of the HDMI cable device 3. Furthermore, the shape of the plug body 53 is analogous or similar to the profile of the hood 51 whose shape corresponds to that of the shell 41 of the HDMI connectors 4 that are provided to the rear face of the optical disk reproduction device 1 or the television set 2. Therefore, when the user connects the HDMI plug 5 to the HDMI connector 4 in a position in which the user looks down the HDMI connector 4 from a top or a side of the optical disk reproduction device 1 or the television set 2 (i.e., a position in which the user can not face the HDMI connector 4 squarely), it is still simple to connect the optical disk reproduction device 1 or the television set 2 with the HDMI cable device 3. Furthermore, this constitution is simple, so an economical HDMI cable device 3 and information reproduction system S can be obtained.

Also, since the cross sectional shape of the plug body 53 as viewed from the insertion direction of the shell 41 is a simple one, its mold can also have a simple shape, which permits mass production and reduces cost.

Second Embodiment

Referring now to FIGS. 7B, 9A, 9B and 10, an HDMI cable device 103 having a modified HDMI plug 105 in accordance with a second embodiment of the present invention will now be explained. The HDMI plug 105 of this second embodiment is utilized in place of the HDMI plug 5 of the first embodiment.

In view of the similarity between the first and second embodiments, the parts of the second embodiment that are identical to the parts of the first embodiment will be given the same reference numerals as the parts of the first embodiment. Also, parts of this second embodiment that are functionally identical and/or substantially identical to parts of the first embodiment will be given the same reference numerals but with "100" added thereto. In any event, the descriptions of the parts of the second embodiment that are substantially identical to the parts of the first embodiment may be omitted for the sake of brevity. However, it will be apparent to those skilled in the art from this disclosure that the descriptions and illustrations of the first embodiment also apply to this second embodiment, except as discussed and/or illustrated herein.

Figure 9A:
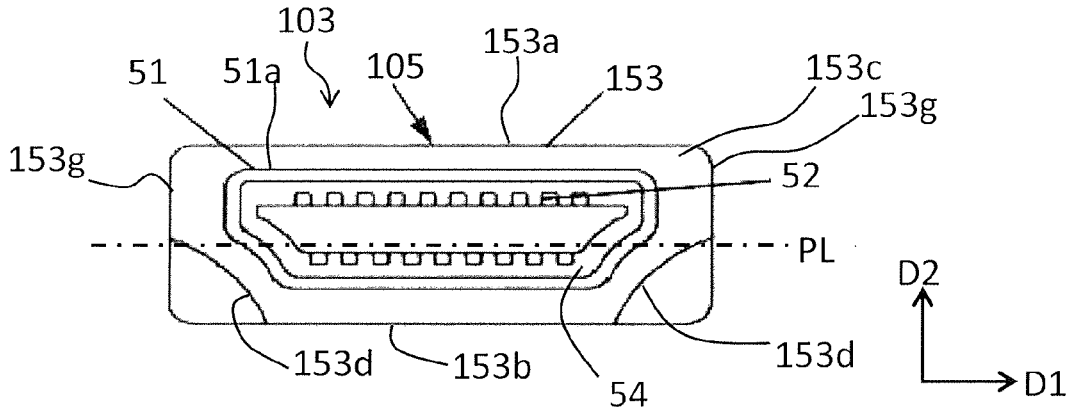
FIG. 9A is a front elevational view of an HDMI cable device in accordance with a second embodiment.
Figure 10:
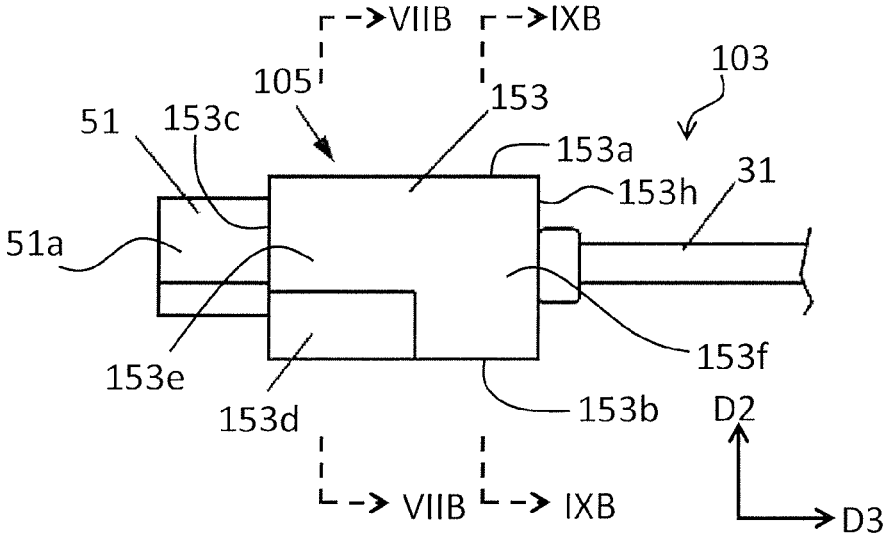
FIG. 10 is a side elevational view of the HDMI cable device illustrated in FIG. 9A.

As shown in FIGS. 9A and 10, the plug body 153 includes front and rear body parts (e.g., front and rear bodies) 153*e* and 153*f*. The hood 51 protrudes from a front face 153*c* of the front body part 153*e*. The rear body part 153*f* is disposed rearward relative to the front body part 153*e* in the axial direction D3. Furthermore, the HDMI cable 31 extends rearward from a rear face 153*h* of the rear body part 153*f* in a direction parallel to the axial direction D3.

Figure 9B:
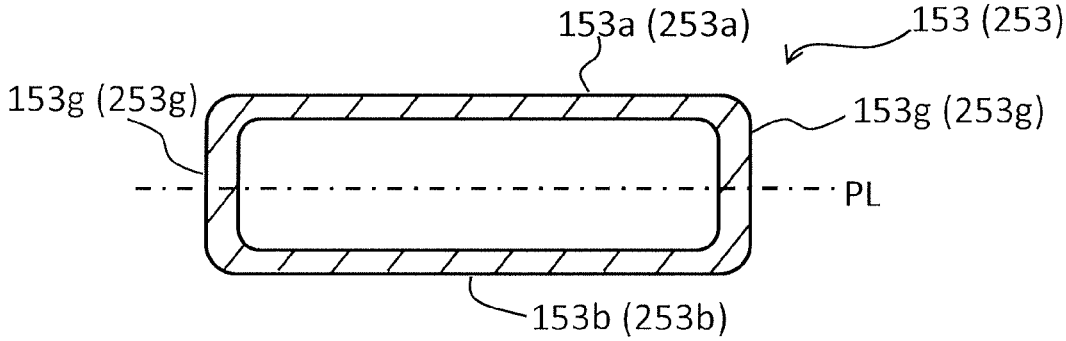
FIG. 9B is a cross sectional view of a plug body of the HDMI cable device taken along the IXB-IXB line in FIGS. 10 and 12.

In this embodiment, only the front body part 153*e* on the hood 51 side of the plug body 153 has a cross sectional shape, as viewed from the insertion direction of the plug body 153 (i.e., axial direction D3), that is an inverse trapezoidal shape similar to that of the hood 51. More specifically, as shown in FIG. 7B, the front body part 153*e* has the same cross sectional shape as that of the plug body 53 of the HDMI plug 5 of the first embodiment. Furthermore, the front body part 153*e* has a pair of slope faces 153*d*. Thus, the front body part 153*e* has a vertically asymmetrical shape with respect to the horizontal plane PL. Furthermore, as shown in FIG. 9B, a cross sectional shape of the rear body part 153*f* of the plug body 153 is a rectangle with round corners. In other words, the rear body part 153*f* is a cuboid with round edges. Moreover, as shown in FIG. 9B, the rear body part 153*f* has a vertically symmetrical shape with respect to the horizontal plane PL.

When the user connects the optical disk reproduction device 1 and the television set 2 with the HDMI cable device 103, the user can easily recognize that there is only one correct insertion direction merely by grasping or touching to the front body part 153*e* of the plug body 153 of the HDMI cable device 103, which makes connection of the optical disk reproduction device 1 or the television set 2 with the HDMI cable device 103 simple. Furthermore, the constitution thereof is simple, so an inexpensive HDMI cable device 103 and information reproduction system S can be obtained.

Third Embodiment

Referring now to FIGS. 7B, 9B, 11 and 12, an HDMI cable device 203 having a modified HDMI plug 205 in accordance with a third embodiment of the present invention will now be explained. The HDMI plug 205 of this third embodiment is utilized in place of the HDMI plug 5 of the first embodiment.

In view of the similarity between the first and third embodiments, the parts of the third embodiment that are identical to the parts of the first embodiment will be given the same reference numerals as the parts of the first embodiment. Also, parts of this third embodiment that are functionally identical and/or substantially identical to parts of the first embodiment will be given the same reference numerals but with "200" added thereto. In any event, the descriptions of the parts of the third embodiment that are substantially identical to the parts of the first embodiment may be omitted for the sake of brevity. However, it will be apparent to those skilled in the art from this disclosure that the descriptions and illustrations of the first embodiment also apply to this third embodiment, except as discussed and/or illustrated herein.

Figure 11:
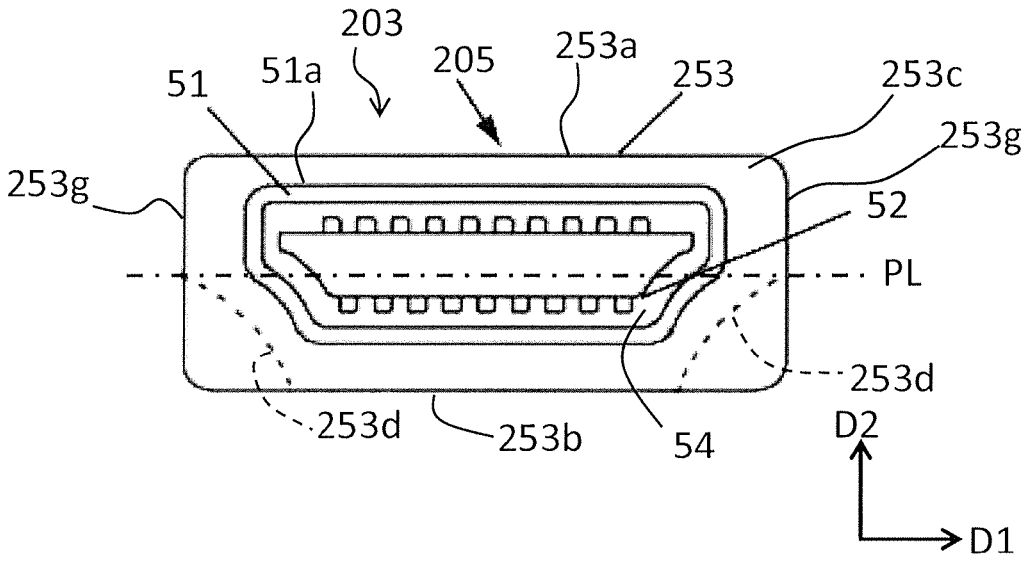
FIG. 11 is a front elevational view of an HDMI cable device in accordance with a third embodiment.
Figure 12:
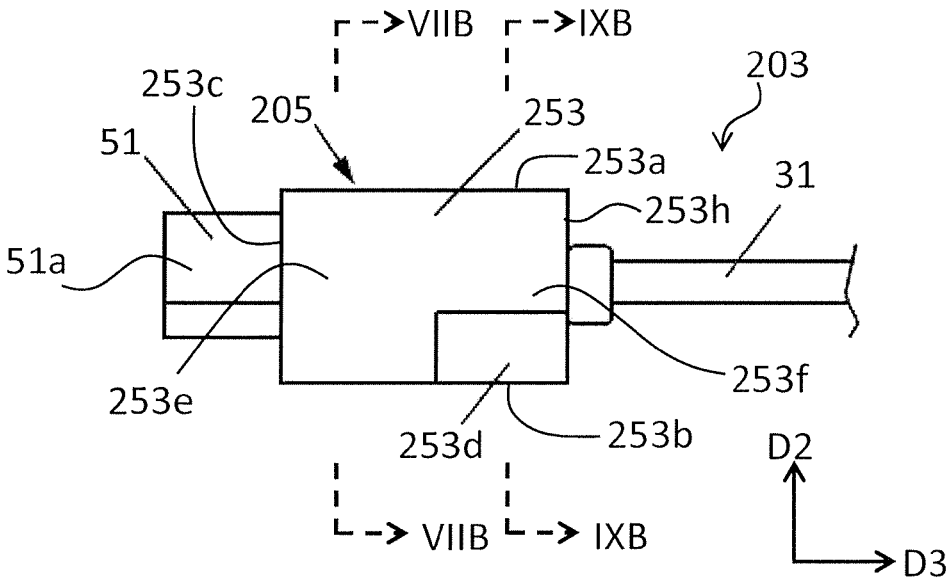
FIG. 12 is a side elevational view of the HDMI cable device illustrated in FIG. 11.

As shown in FIGS. 11 and 12, the plug body 253 includes front and rear body parts (e.g., front and rear bodies) 253*e* and 253*f*. The hood 51 protrudes from a front face 253*c* of the front body part 253*e*. The rear body part 253*f* is disposed rearward relative to the front body part 253*e* in the axial direction D3. Furthermore, the HDMI cable 31 extends rearward from a rear face 253*h* of the rear body part 253*f* in a direction parallel to the axial direction D3.

In this embodiment, only the rear body part 253*f* on the HDMI cable 31 side of the plug body 253 has a cross sectional shape, as viewed from the insertion direction of the plug body 253 (i.e., axial direction D3), that is an inverse trapezoidal shape similar to that of the hood 51. More specifically, as shown in FIG. 7B, the rear body part 253*f* has the same cross sectional shape as that of the plug body 53 of the HDMI plug 5 of the first embodiment. Furthermore, the rear body part 253*f* has a pair of slope faces 253*d*. Thus, the rear body part 253*f* has a vertically asymmetrical shape with respect to the horizontal plane PL. Furthermore, as shown in FIG. 9B, a cross sectional shape of the front body part 253*e* of the plug body 253 is a rectangle with round corners. In other words, the front body part 253*e* is a cuboid with round edges. Moreover, as shown in FIG. 9B, the front body part 253*e* has a vertically symmetrical shape with respect to the horizontal plane PL.

When the user connects the optical disk reproduction device 1 and the television set 2 with the HDMI cable device 203, the user can easily recognize that there is only one correct insertion direction merely by grasping or touching to the rear body part 253*f* of the plug body 253 of the HDMI cable device 203, which makes connection of the optical disk reproduction device 1 or the television set 2 with the HDMI cable device 203 simple. Furthermore, the constitution thereof is simple, so an inexpensive HDMI cable device 203 and information reproduction system S can be obtained.

Fourth Embodiment

Figure 13:
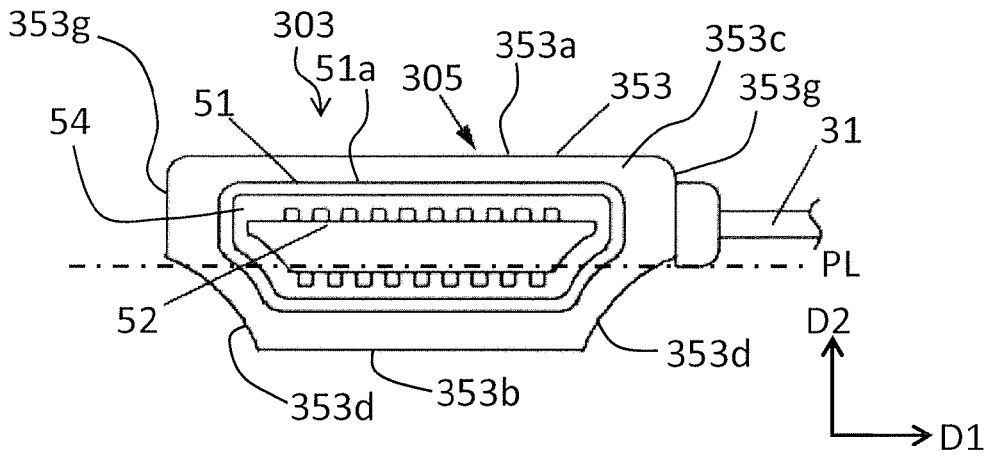
FIG. 13 is a front elevational view of an HDMI cable device in accordance with a fourth embodiment.
Figure 14:
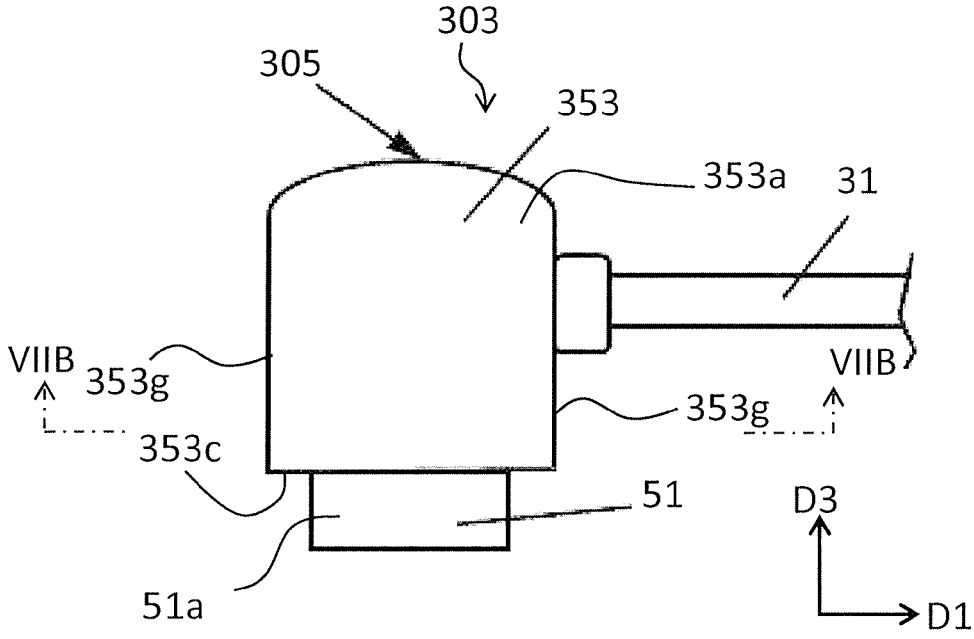
FIG. 14 is a top plan view of the HDMI cable device illustrated in FIG. 13.

Referring now to FIGS. 7B, 13 and 14, an HDMI cable device 303 having a modified HDMI plug 305 in accordance with a fourth embodiment of the present invention will now be explained. The HDMI plug 305 of this fourth embodiment is utilized in place of the HDMI plug 5 of the first embodiment.

In view of the similarity between the first and fourth embodiments, the parts of the fourth embodiment that are identical to the parts of the first embodiment will be given the same reference numerals as the parts of the first embodiment. Also, parts of this fourth embodiment that are functionally identical and/or substantially identical to parts of the first embodiment will be given the same reference numerals but with "300" added thereto. In any event, the descriptions of the parts of the fourth embodiment that are substantially identical to the parts of the first embodiment may be omitted for the sake of brevity. However, it will be apparent to those skilled in the art from this disclosure that the descriptions and illustrations of the first embodiment also apply to this fourth embodiment, except as discussed and/or illustrated herein.

In this embodiment, the plug body 353 has a cross sectional shape, as viewed from the insertion direction of the plug body 353 (i.e., axial direction D3), that is an inverse trapezoidal shape similar to that of the hood 51. More specifically, as shown in FIG. 7B, the plug body 353 has the same cross sectional shape as that of the plug body 53 of the HDMI plug 5 of the first embodiment. Furthermore, the plug body 353 has a pair of slope faces 353*d*. Thus, the plug body 353 has a vertically asymmetrical shape with respect to the horizontal plane PL.

Furthermore, as shown in FIGS. 13 and 14, the HDMI plug 305 is at an angle of 90 degrees to the HDMI cable 31. In other words, the HDMI cable 31 and the HDMI plug 305 (the hood 51 and the plug terminals 52) are at a right angle. Specifically, as shown in FIG. 14, the hood 51 axially protrudes from a front face 353*c* of the plug body 353 in the axial direction D3. The HDMI cable 31 laterally extends in the horizontal direction D1 from a side face (e.g., first side face) 353*g* of the plug body 353. The horizontal direction D1 is perpendicular to the axial direction D3 of the hood 51 of the HDMI plug 305.

Also, in this example, the layout is lateral. In other words, the HDMI cable 31 laterally extends from the side face 353*g* of the plug body 353. However, it goes without saying that the layout can be longitudinal so that the HDMI cable 31 is disposed on a lower face 353*b* side of the HDMI plug 305, although this layout is not depicted. In other words, the HDMI cable 31 can longitudinally extend from the lower face 353*b* of the plug body 353 in a direction parallel to the vertical direction D2.

With this embodiment constituted as above, in addition to the same effects as in the first to third embodiments given above, since the HDMI plug 305 is disposed in a lateral layout (or longitudinal layout), a connection can be made that matches the orientation of the HDMI connectors 4 of the optical disk reproduction device 1 and the television set 2. As a result, the optical disk reproduction device 1 and the television set 2 will take up less space when installed, and the wiring at the rear face of the optical disk reproduction device 1 and the television set 2 will have a neater appearance.

In the first to fourth embodiments, the optical disk reproduction device 1 is illustrated as an example of the information reproduction device, and the television set 2 is illustrated as the video display device, but it should go without saying that the HDMI cable devices 3, 103, 203, and 303 can also be applied to other information reproduction devices and/or video display devices.

General Interpretation of Terms

In understanding the scope of the present invention, the term "comprising" and its derivatives, as used herein, are intended to be open ended terms that specify the presence of the stated features, elements, components and groups, but do not exclude the presence of other unstated features, elements, components and groups. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of an electric cable device equipped with the present invention. Accordingly, these terms, as utilized to describe the present invention should be interpreted relative to an electric cable device equipped with the present invention as used in the normal operating position.

While only selected embodiments have been chosen to illustrate the present invention, it will be apparent to those skilled in the art from these disclosures that various changes and modifications can be made herein without departing from the scope of the invention as defined in the appended claims. The functions of one element can be performed by two, and vice versa. Every feature which is unique from the prior art, alone or in combination with other features, also should be considered a separate description of further inventions by the applicant, including the structural and/or functional concepts embodied by such feature. Furthermore, the foregoing descriptions of the selected embodiments according to the present invention are provided for illustration only, and not for the purpose of limiting the invention as defined by the appended claims and their equivalents.

What is claimed is:

1. An electric cable device comprising:

an electric cable; and a plug component coupled to at least one end portion of the electric cable, the plug component including a terminal body with a plurality of plug terminals, the plug terminals being electrically coupled to the electric cable, a hood component disposed around the terminal body, the hood component having a width measured in a first direction of the plug component, the width of the hood component being greater than a height of the hood component that is measured in a second direction of the plug component, the first direction being perpendicular to the second direction, and a plug body disposed around part of the hood component such that the hood component protrudes from the plug body in a third direction of the plug component with the third direction being perpendicular to the first and second directions, the plug body being asymmetrically formed relative to any of planes that are perpendicular to the second direction, the hood component having an outer profile shape with a pair of concave corners when viewed in the third direction of the plug component, at least part of the plug body having an outer profile shape with a pair of concave corners when viewed in the third direction of the plug component, with the concave corners of the plug body being disposed at locations corresponding to the concave corners of the hood component, respectively, when viewed in the third direction of the plug component.

2. The electric cable device according to claim 1, wherein the part of the plug body has a first slope face that extends between a first side face of the plug body and a lower face of the plug body, and a second slope face that extends between a second side face of the plug body and the lower face of the plug body, the first and second side faces of the plug body being perpendicular to the first direction, the lower face of the plug body being perpendicular to the second direction.

3. The electric cable device according to claim 2, wherein a cross sectional shape of the part of the plug body has an outer profile that corresponds in shape to an outer profile of a cross sectional shape of the hood component.

4. The electric cable device according to claim 3, wherein the first and second slope faces extend entirely along the plug body in the third direction.

5. The electric cable device according to claim 4, wherein the one end portion of the electric cable extends from a rear face of the plug body in a direction parallel to the third direction.

6. The electric cable device according to claim 4, wherein the one end portion of the electric cable extends from the first side face of the plug body in a direction parallel to the first direction.

7. The electric cable device according to claim 3, wherein the plug body includes a front body from which the hood component protrudes, and a rear body that is disposed rearward relative to the front body in the third direction, the front body of the plug body having the first and second slope faces, the rear body being symmetrically formed relative to one of the planes that are perpendicular to the second direction.

8. The electric cable device according to claim 7, wherein the one end portion of the electric cable extends from a rear face of the plug body in a direction parallel to the third direction.

9. The electric cable device according to claim 3, wherein the plug body includes a front body from which the hood component protrudes, and a rear body that is disposed rearward relative to the front body in the third direction, the rear body of the plug body having the first and second slope faces, the front body being symmetrically formed relative to one of the planes that are perpendicular to the second direction.

10. The electric cable device according to claim 9, wherein the one end portion of the electric cable extends from a rear face of the plug body in a direction parallel to the third direction.

11. The electric cable device according to claim 1, wherein the hood component and the plug body are separately formed as independent members.

12. The electric cable device according to claim 11, wherein the hood component is made of metal, and the plug body is made of synthetic resin.

13. The electric cable device according to claim 1, wherein the plug component conforms to HDMI specifications.

14. An information reproduction system comprising:

an information reproduction device with a first socket component;

a display device with a second socket component; and an electric cable device electrically coupled between the information reproduction device and the display device, the electric cable device including an electric cable, and first and second plug components coupled to both end portions of the electric cable, respectively, the first plug component being coupled to the first socket component of the information reproduction device, the second plug component being coupled to the second socket component of the display device, each of the first and second plug components including a terminal body with a plurality of plug terminals, the plug terminals being electrically coupled to the electric cable, a hood component disposed around the terminal body, the hood component having a width measured in a first direction, the width of the hood component being greater than a height of the hood component that is measured in a second direction, the first direction being perpendicular to the second direction, and a plug body disposed around part of the hood component such that the hood component protrudes from the plug body in a third direction that is perpendicular to the first and second directions, the plug body being asymmetrically formed relative to any of planes that are perpendicular to the second direction, the hood component having an outer profile shape with a pair of concave corners when viewed in the third direction, at least part of the plug body having an outer profile shape with a pair of concave corners when viewed in the third direction, with the concave corners of the plug body being disposed at locations corresponding to the concave corners of the hood component, respectively, when viewed in the third direction.

15. The information reproduction system according to claim 14, wherein the hood component and the plug body of each of the first and second plug components are separately formed as independent members.

16. The information reproduction system according to claim 15, wherein the hood component of each of the first and second plug components is made of metal, and the plug body of each of the first and second plug components is made of synthetic resin.

17. The information reproduction system according to claim 14, wherein the first and second plug components conform to HDMI specifications.

* * * * *